US012264493B2

(12) United States Patent
Muc

(10) Patent No.: US 12,264,493 B2
(45) Date of Patent: Apr. 1, 2025

(54) FENCE PANEL

(71) Applicant: MODU-LOC FENCE RENTALS LP, Toronto (CA)

(72) Inventor: Christopher Muc, Etobicoke (CA)

(73) Assignee: SUNBELT RENTALS OF CANADA, Oldcastle (CA)

( * ) Notice: Subject to any disclaimer, the term of this patent is extended or adjusted under 35 U.S.C. 154(b) by 380 days.

(21) Appl. No.: 17/859,516

(22) Filed: Jul. 7, 2022

(65) Prior Publication Data

US 2024/0011321 A1 Jan. 11, 2024

(51) Int. Cl.
*E04H 17/16* (2006.01)
*E04H 17/06* (2006.01)

(52) U.S. Cl.
CPC ..... *E04H 17/161* (2013.01); *E04H 17/06* (2013.01); *E04H 17/17* (2021.01)

(58) Field of Classification Search
CPC . E04H 17/14; E04H 17/1413; E04H 17/1447; E04H 17/1488; E04H 17/16; E04H 17/161; E04H 17/163; E04H 17/165; E04H 17/17; E04H 17/24
See application file for complete search history.

(56) References Cited

U.S. PATENT DOCUMENTS 547,585 A * 10/1895 Lusk ..... F16B 12/2009 52/657
1,641,523 A * 9/1927 Bell ..... E06B 9/01 160/381
2,323,699 A * 7/1943 Babros ..... A47G 5/04 160/381
3,704,005 A 11/1972 Kusel
3,719,389 A 3/1973 Burton et al.
3,848,855 A 11/1974 Weiland
(Continued)

FOREIGN PATENT DOCUMENTS

CN 306080868 9/2020
DE 1905122 A1 * 8/1970
(Continued)

OTHER PUBLICATIONS

"Anticlimb Premium Fence Panel", Broadfence, Available Online at: https://www.broadfence.com/product/anticlimb-premium-fence-panel/, Oct. 2020, pp. 1-10.
(Continued)

*Primary Examiner* — Jonathan P Masinick
(74) *Attorney, Agent, or Firm* — Kilpatrick Townsend & Stockton LLP

(57) ABSTRACT

There is provided a stackable fencing panel and a method for stacking fencing panels. The fencing panel including: a first outside post including a post depth; a second outside post opposing the first outside post and including the post depth; and two or more horizontal cross-members each intermediate the first outside post and the second outside post, each horizontal cross-member including a cross-member depth, each horizontal cross-member including a narrowed section proximate both the first outside post and the second outside post, the narrowed sections including a narrowed depth less than the post depth.

19 Claims, 12 Drawing Sheets

(56) References Cited

U.S. PATENT DOCUMENTS

| | | | | |
|---|---|---|---|---|
| RE28,493 | E * | 7/1975 | Weeden | E04G 21/3233 256/65.04 |
| 4,136,985 | A * | 1/1979 | Taul | B62D 33/044 403/172 |
| 6,279,879 | B1 | 8/2001 | Statz | |
| 6,536,745 | B2 | 3/2003 | Roark | |
| 6,619,631 | B2 * | 9/2003 | Painter | E04H 17/1413 256/65.01 |
| 6,779,781 | B2 | 8/2004 | Bebendorf | |
| 6,896,437 | B2 * | 5/2005 | Morgan | F16B 7/0446 135/909 |
| 7,111,828 | B2 | 9/2006 | Rosine et al. | |
| D737,469 | S | 8/2015 | Bucarizza | |
| D737,471 | S | 8/2015 | Bucarizza | |
| D737,995 | S | 9/2015 | Bucarizza | |
| D737,996 | S | 9/2015 | Bucarizza | |
| D738,535 | S | 9/2015 | Bucarizza | |
| 9,822,549 | B2 | 11/2017 | Gentry et al. | |
| D899,626 | S | 10/2020 | Muc | |
| 10,808,418 | B2 * | 10/2020 | Thiem | E04H 17/1447 |
| 10,961,672 | B2 | 3/2021 | Wahlin | |
| 2007/0194293 | A1 * | 8/2007 | Edens | E04H 17/14 256/19 |
| 2012/0285636 | A1 | 11/2012 | Meza et al. | |
| 2013/0139461 | A1 | 6/2013 | Herbertsson et al. | |
| 2013/0168625 | A1 | 7/2013 | Machacek et al. | |
| 2016/0145891 | A1 | 5/2016 | Mccarty et al. | |
| 2016/0362907 | A1 | 12/2016 | Pinneri et al. | |
| 2018/0223561 | A1 | 8/2018 | Howell | |
| 2019/0093387 | A1 | 3/2019 | Ash | |
| 2019/0186157 | A1 | 6/2019 | Melic et al. | |
| 2021/0115699 | A1 | 4/2021 | Muc | |
| 2022/0205273 | A1 | 6/2022 | Vingerhoets | |
| 2022/0282521 | A1 * | 9/2022 | Erdman | E04H 17/17 |
| 2023/0203835 | A1 | 6/2023 | Vadas | |

FOREIGN PATENT DOCUMENTS

| | | | | |
|---|---|---|---|---|
| DE | 9307229 | U1 * | 9/1993 | |
| DE | 10356220 | A1 * | 7/2005 | E04H 17/161 |
| DE | 202015105483 | U1 * | 12/2015 | E04H 17/163 |
| DE | 202018106324 | U1 | 12/2018 | |
| EM | 003360619-0008 | | 9/2016 | |
| EP | 0738810 | A1 * | 10/1996 | |
| FR | 1176938 | A * | 4/1959 | |
| FR | 2490716 | A1 | 3/1982 | |
| GB | 2235225 | A | 2/1991 | |
| GB | 2357782 | A * | 7/2001 | E04H 17/1413 |
| GB | 2370050 | A | 6/2002 | |
| JP | D1526727 | | 6/2015 | |
| KR | 20090041280 | A * | 4/2009 | |
| KR | 300705169.0001 | | 8/2013 | |
| WO | WO-2009023274 | A1 * | 2/2009 | A01K 1/03 |

OTHER PUBLICATIONS

"Commercial Temporary Fence Panels", Canpad, Available Online at: https://canpad.ca/commercial/, Jan. 2016, pp. 1-2.

"Galvanized Wire Mesh Fence", GI Welded Fence Panel, Available Online at: https://wanzhifence.com/galvanized-wire-mesh-fence/, Aug. 2021, pp. 1-8.

"WireWorks Anti-Climb", Ameristar, Available Online at: https://www.ameristarperimeter.com/US/en/products/high-security-fence/wireworks-anti-climb, Jul. 2020, pp. 1-5.

Design U.S. Appl. No. 29/845,429 , "Non-Final Office Action", Dec. 1, 2023, 8 pages.

Design U.S. Appl. No. 29/845,429 , "Notice of Allowance", Apr. 26, 2024, 6 pages.

PCT/IB2023/057012 , "International Search Report and Written Opinion", Oct. 5, 2023, 11 pages.

Office action for Canadian application No. 193400, CIPO, dated: Aug. 10, 2021.

Office action for Canadian application No. 193400, CIPO, dated: Jul. 5, 2022.

Office action for Canadian application No. 3,059,693, CIPO, dated: Jun. 15, 2021.

Office action for Canadian application No. 3,059,693, CIPO, dated: Sep. 9, 2021.

Office action for U.S. Appl. No. 16/659,669, USPTO, notification date: Jul. 12, 2021.

Office action for U.S. Appl. No. 16/659,669, USPTO, notification date: Nov. 22, 2021.

Office action for U.S. Appl. No. 16/659,669, USPTO, notification date: Dec. 29, 2021.

Office action for U.S. Appl. No. 16/659,669, USPTO, notification date: Aug. 31, 2021.

* cited by examiner

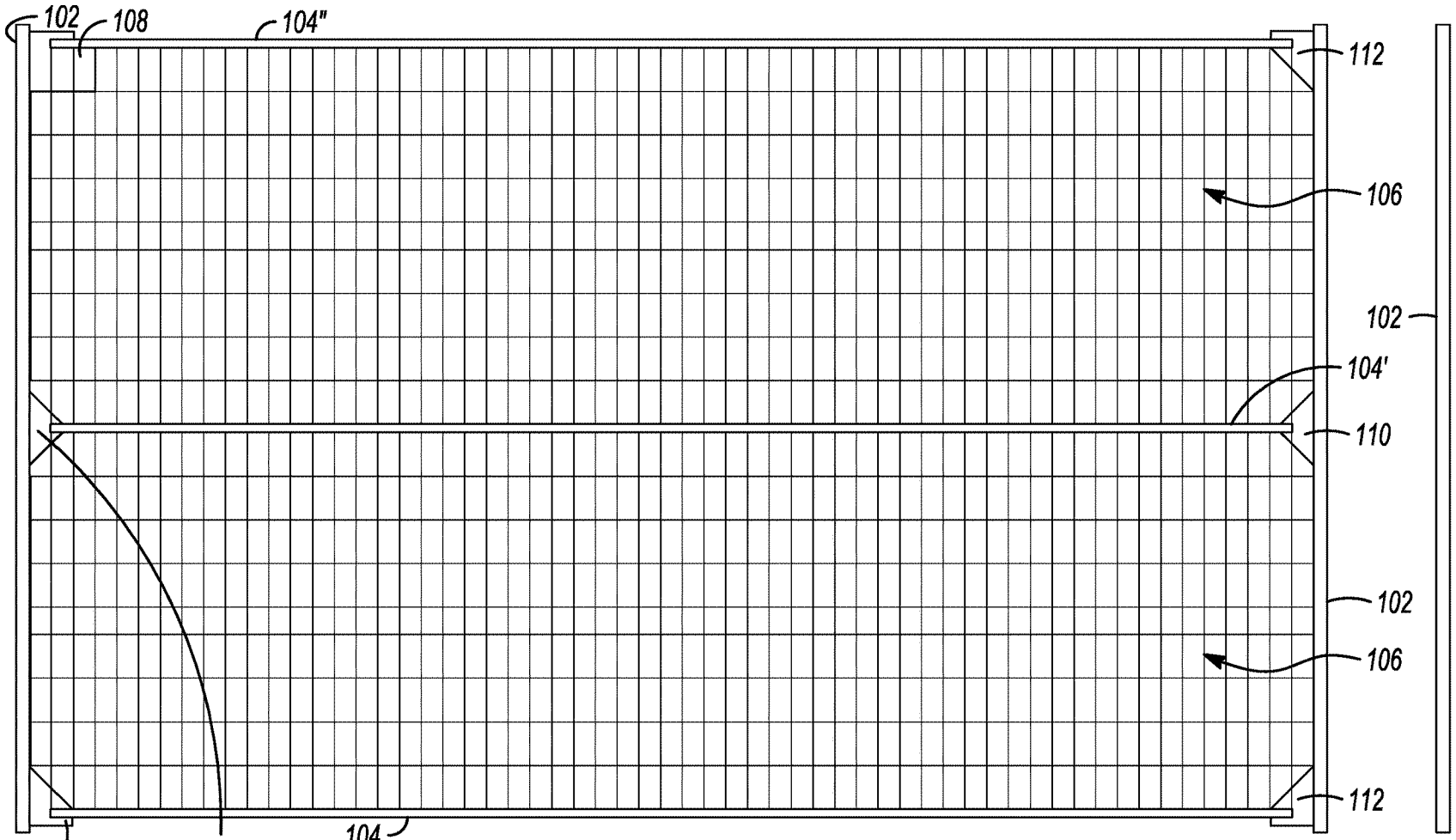
FIG. 2
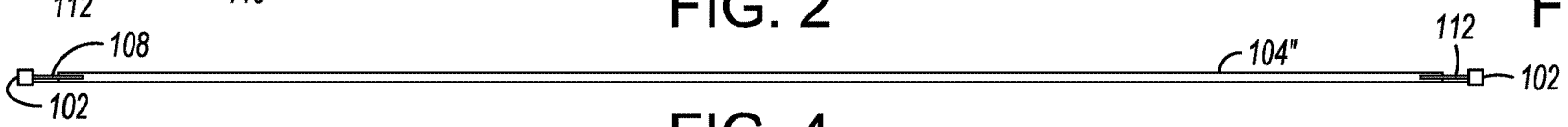
FIG. 3
FIG. 4

FENCE PANEL

TECHNICAL FIELD

The following relates generally to physical barriers, and more specifically, to a stackable fencing panel.

BACKGROUND

Barriers often are required to be erected at, for example, construction sites, festivals, events, or the like. An example of such a barrier is temporary fencing. Temporary fencing typically includes a series of interconnected fence panels; with each fence panel including two outside posts interconnected by, for example, boards, wire, rails, netting, or the like. Temporary fencing is generally trucked, shipped, or otherwise transported between storage and various sites by stacking up these fence panels.

SUMMARY

In one aspect, a stackable fencing panel is provided, the fencing panel comprising: a first and a second outside post each comprising a post depth; an upper and a lower cross-member each disposed between the first and second outside post and each comprising a cross-member depth; a plurality of interface plates, each interface plate connecting each of the outside posts to each of the cross-members to form a frame, the interface plate having a thickness less than the post depth and less than the cross-member depth; and a wire mesh affixed within the frame; the interface plate having a notch formed therein for retaining the respective cross-member spaced apart from the outside post by at least the post depth.

In a particular case, the first outside post and the second outside post comprise a square tube.

In a particular case, the cross-members comprise a square tube.

In a particular case, the stackable fencing panel further comprises a middle cross-member disposed in parallel midway between the upper and lower cross members defining two rectangular openings, the wire mesh affixed within one of the two rectangular openings and a further wire mesh affixed with the other of the two rectangular openings.

In a particular case, the wire mesh is a grid of rectangles formed of intersecting horizontal and vertical wire.

In a particular case, each interface plate comprises a horizontal notch to accommodate the corresponding cross-member.

In a particular case, during assembly, the cross-member is inserted into the notch and welded therein.

In a particular case, each interface plate has a depth narrower than a depth of each cross-member.

In a particular case, the interface plate and cross-member are centrally aligned along their respective depths.

In a particular case, the notch is spaced apart from a side edge of the interface plate by an interface gap, the interface gap being at least a width of the outside post.

In a particular case, the wire mesh that is affixed to the frame is also welded to each interface plate at meeting points.

In a particular case, the wire mesh is overlaid upon the interface plates.

In a particular case, the wire mesh is aligned along a common vertical center plane of the outside posts, cross-members and interface plates.

In a particular case, the wire mesh is offset from a common vertical center plane of the outside posts, cross-members and interface plates.

In a particular case, a thickness of the interface plates is less that a depth of the outside posts and also less than a depth of the cross-members.

In a particular case, the depth of the cross-members is equal to half of the total sum of the depth of the outside posts and the thickness of the interface plates.

In a particular case, the depth the outside posts is 1.25 inches.

In a particular case, the depth of the cross-members is 0.75 inches.

In a particular case, the depth of the interface plates is 0.25 inches.

In a particular case, the interface gap is 1.9 inches.

BRIEF DESCRIPTION OF THE DRAWINGS

The features of the invention will become more apparent in the following detailed description in which reference is made to the appended drawings wherein:

FIG. 2 illustrates a front view of the fencing panel in FIG. 1;

FIG. 3 illustrates a right view of the fencing panel in FIG. 1;

FIG. 4 illustrates a top view of the fencing panel in FIG. 1;

DETAILED DESCRIPTION

Figure 1:
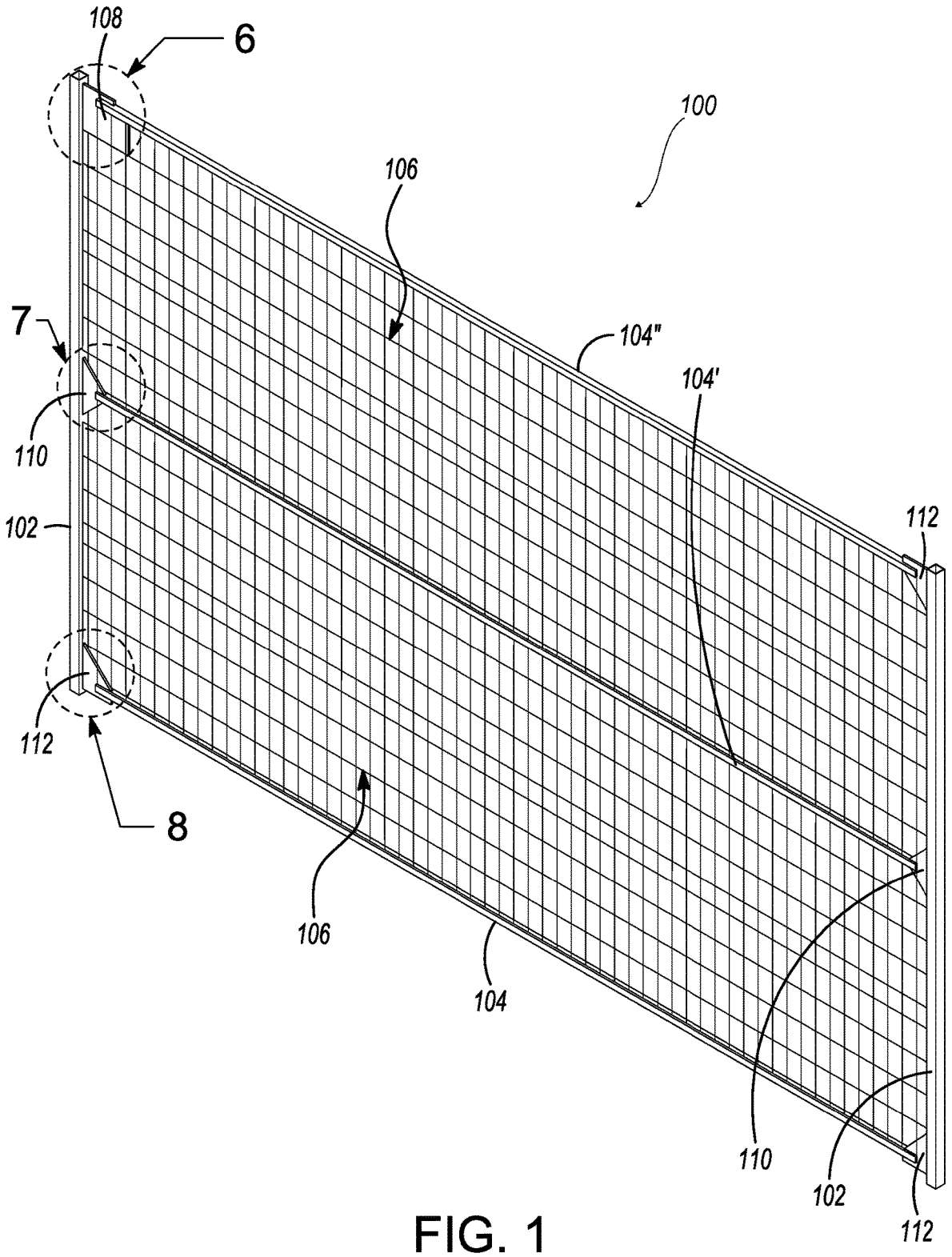
FIG. 1 illustrates an orthographic view of a fencing panel.

Embodiments will now be described with reference to the figures. For simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa;

similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

The following relates generally to physical barriers, and more specifically, to a stackable fencing panel.

Referring first to FIGS. 1 to 4, an example of a fencing panel 100 is shown. In this example, the fencing panel 100 includes two outside posts 102, a plurality of horizontal cross-members, a pair of wire meshes 106, and a plurality of interface plates 108, 110, and 112.

The example shown comprises three horizontal cross-members, comprising an upper 15 cross-member 104" along the upper edge of the wire mesh 106, a lower cross-member 104 16 along the lower edge of the wire mesh 106 and a middle cross-member 104' parallel to the 17 upper 104" and lower cross-members 104 approximately midway therebetween. The fencing 18 panel 100 could be provided without the middle cross-member with some reduction of strength 19 and resilience. Alternatively, more than three cross-members could be provided.

Figure 5:
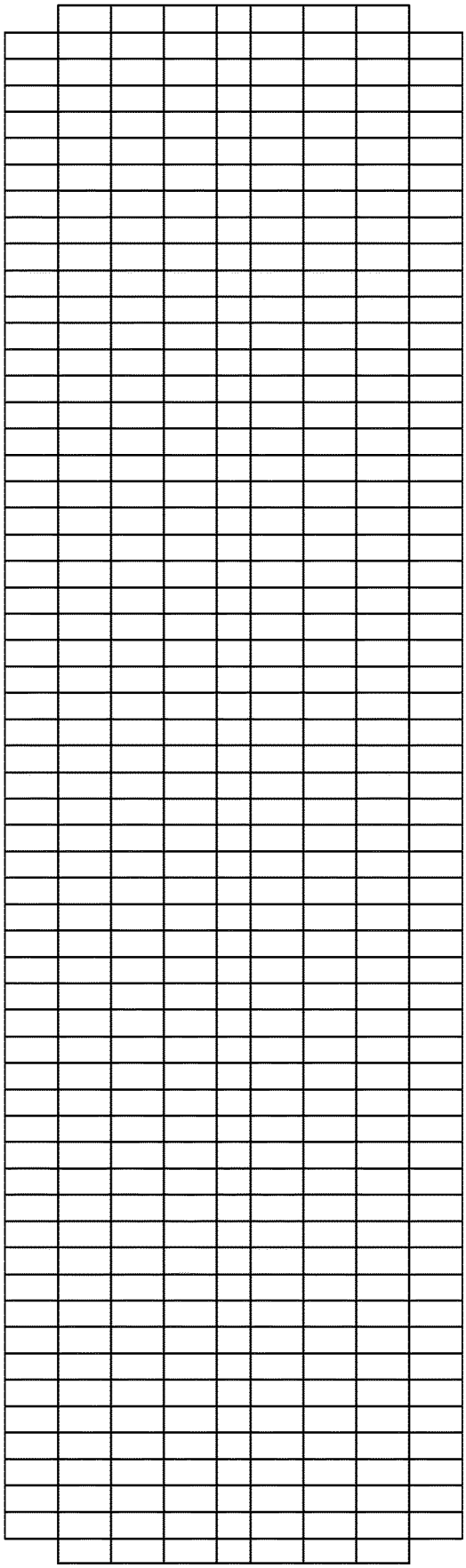
FIG. 5 illustrates a wire mesh.

In this example, there is a wire mesh 106 disposed in each rectangular opening formed by the outside posts 102 and the horizontal cross-members 104, 104', 104". In other words, one wire mesh 106 is disposed between the upper cross-member 104" and middle cross-member 106, and another wire mesh 106 is disposed between the middle cross-member 106 and the lower cross-member 104. FIG. 5 illustrates an example of a wire mesh suitable for such an arrangement. The wire mesh is a grid of rectangles formed of intersecting horizontal and vertical wire with planar edges. The corner rectangles have been omitted to suit the use of the interface plates which are now described in further detail.

Figure 6:
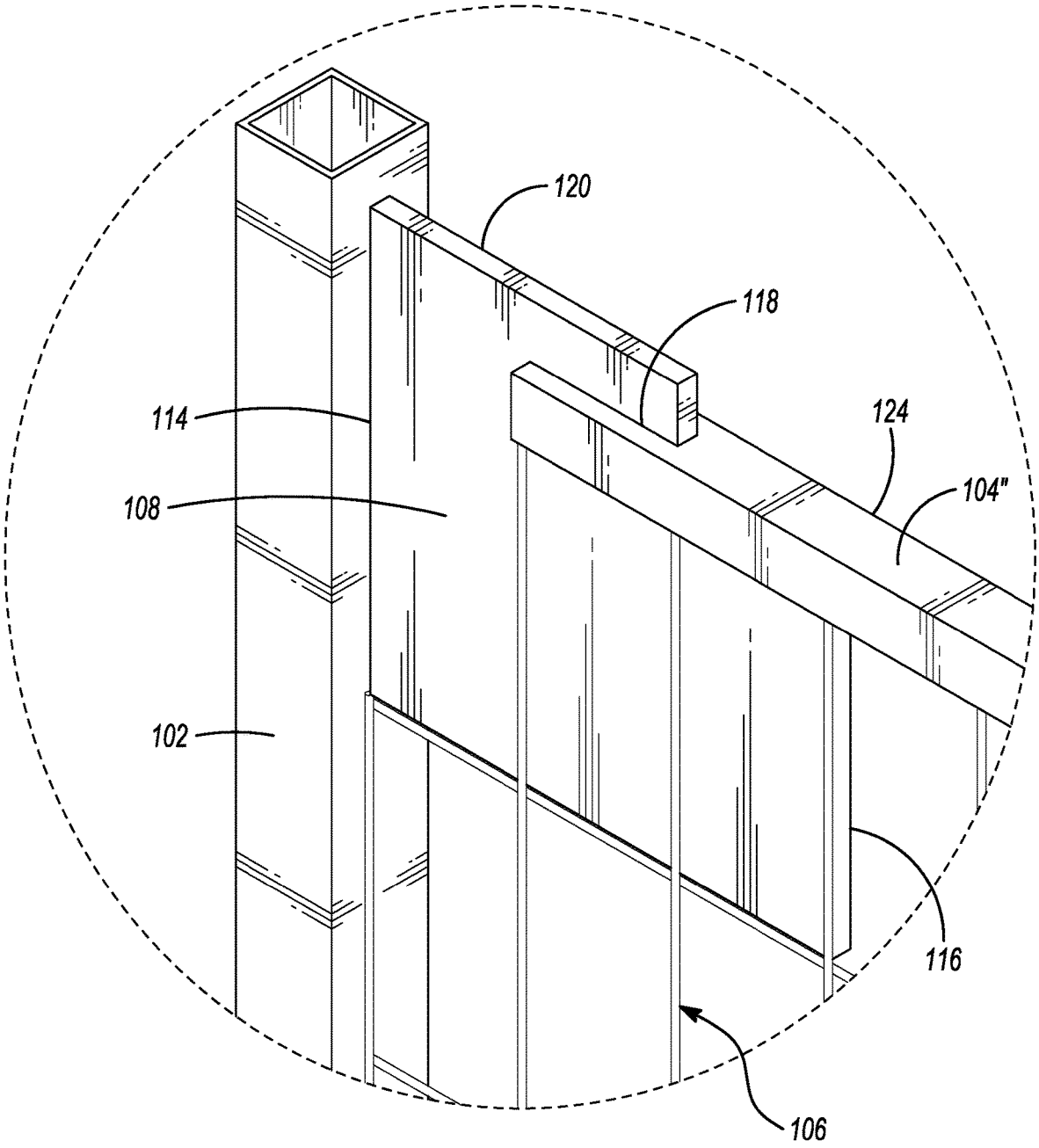
FIG. 6 illustrates a view of an interface plate.
Figure 7:
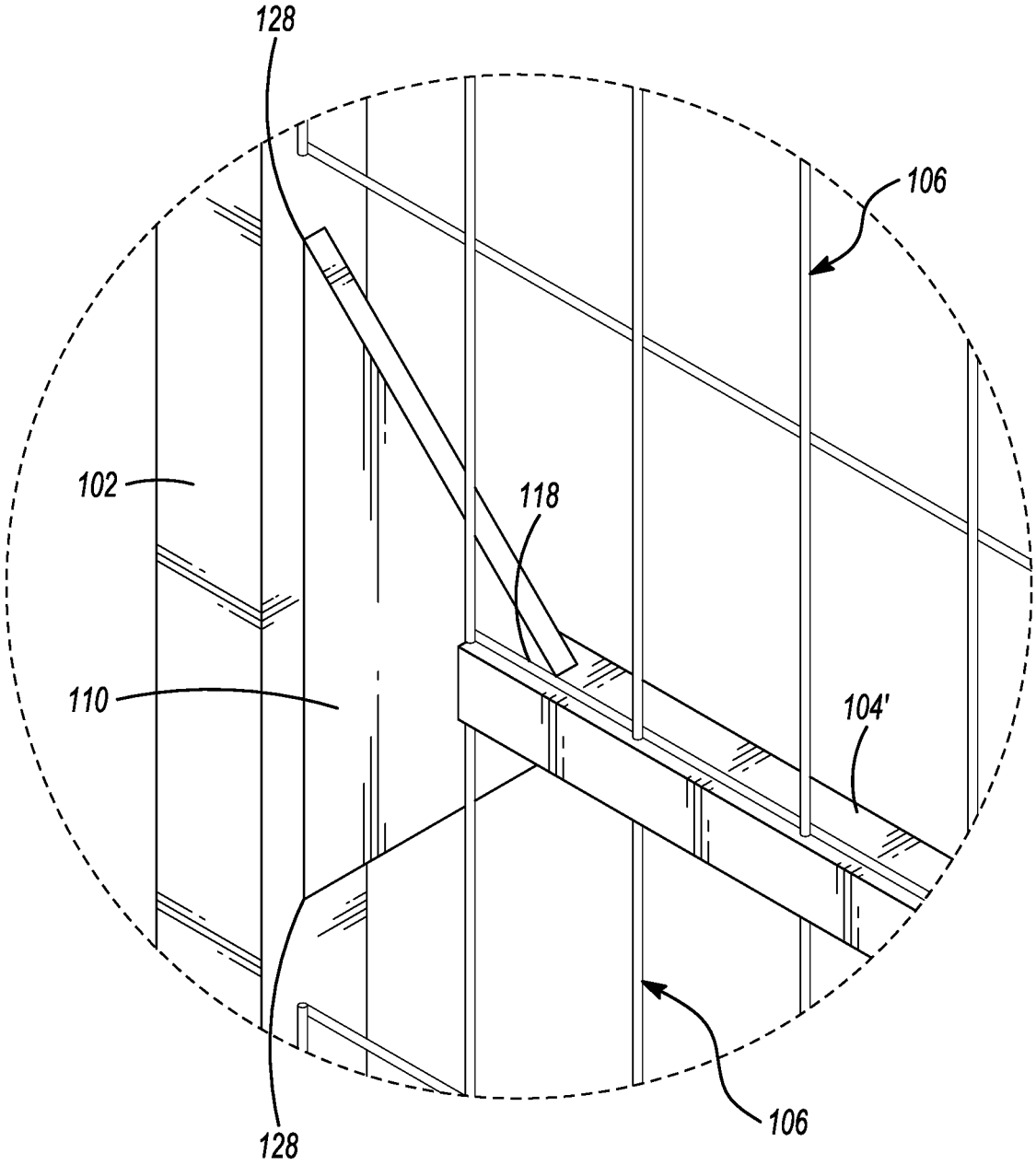
FIG. 7 illustrates a view of another interface plate.
Figure 8:
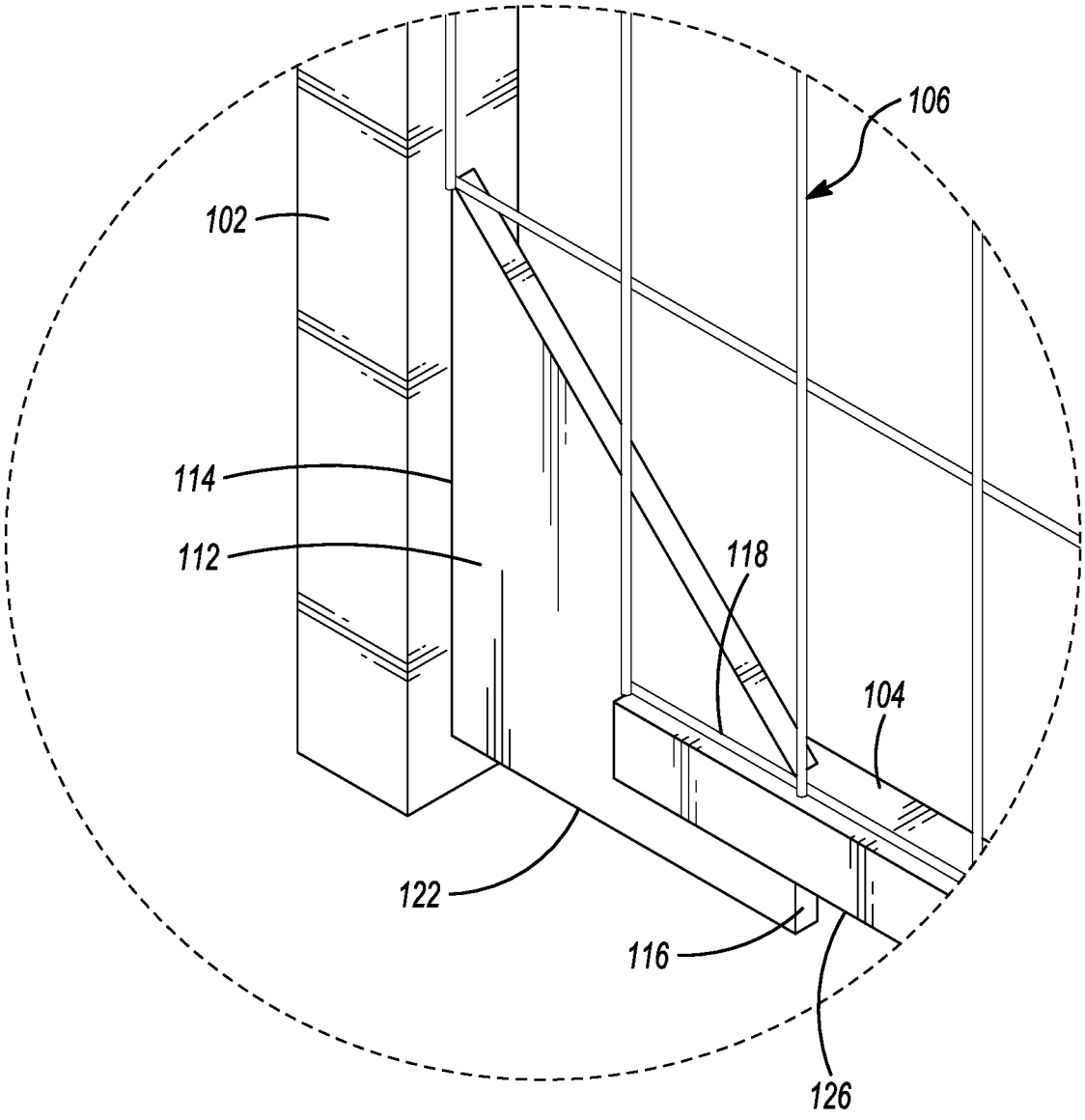
FIG. 8 illustrates a view of yet another interface plate.
Figure 9:
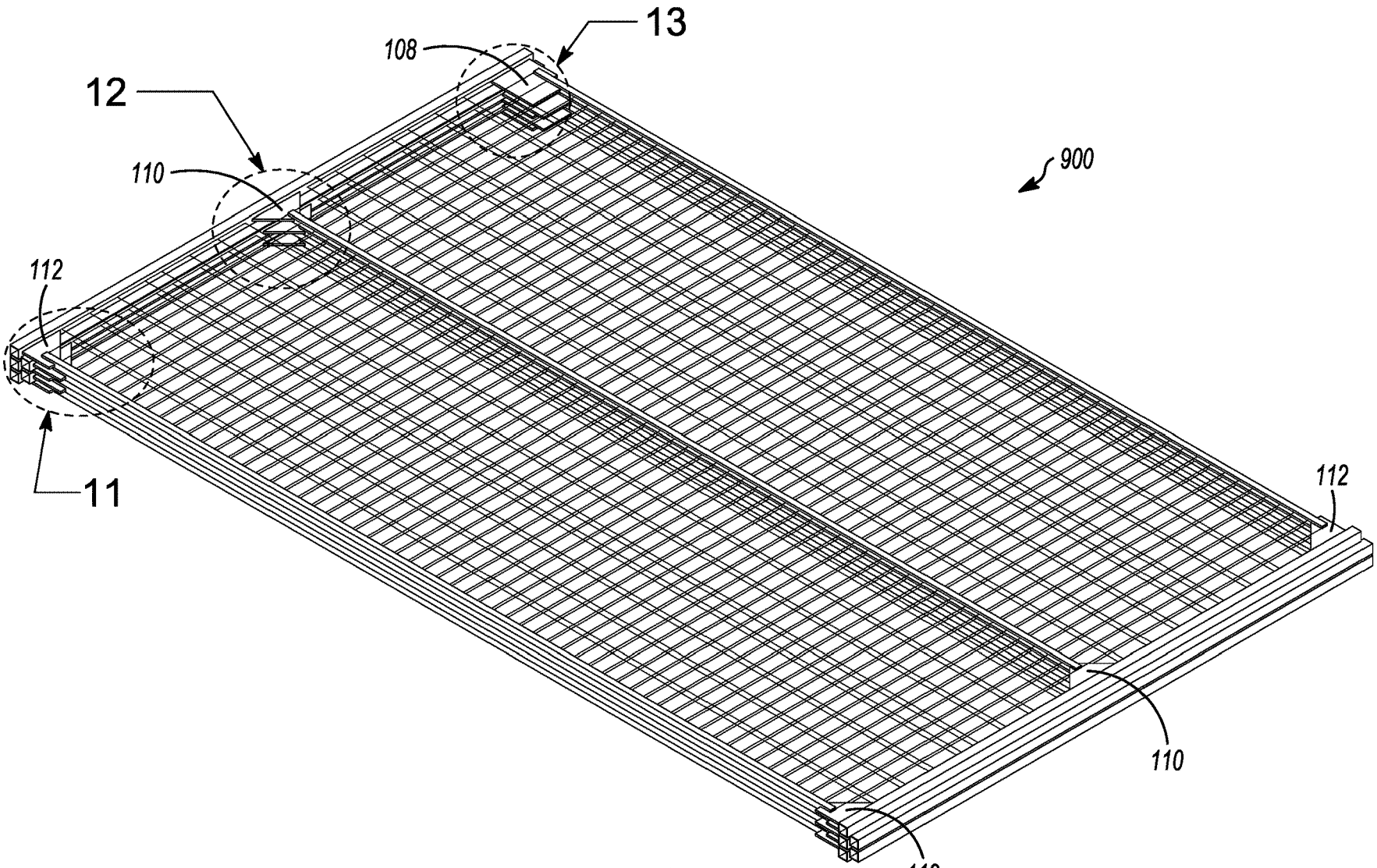
FIG. 9 illustrates a stacking arrangement of fencing panels.

Referring now to FIG. 6, FIG. 7 and FIG. 8, the interface plates are shown in greater detail. The interface plates permit a strong bond between the outside posts 102 and the cross-members. One side edge 114 of each interface plate is affixed to the outside post 102, preferably by welding, while the other side edge 116 of each interface plate is affixed to a corresponding one of the cross-members, again preferably by welding. Thus, as it is demonstrated in FIGS. 1 to 4, each cross-member has at its ends an interface plate, and thereafter is affixed to the outside posts to form a framework for the fencing panel 100.

Each interface plate includes a horizontal notch 118 to accommodate the corresponding cross-member. During assembly, the cross-member is inserted into the notch and welded therein. As will be explained below, the interface plate has a depth narrower than that of the cross-member, and preferably the interface plate and cross-member are centrally aligned along their depths. Additionally, the notch 118 terminates a particular minimum distance from the side edge 114 of the interface plate, that distance being at least the width of the outside post 102. This permits optimal stacking of the fencing panel 100 with like panels, which will be described in more detail below.

In the example shown, the interface plates include a rectangular interface plate 108 on one corner of the fencing panel for the upper cross-member, two triangular interface plates 110 for the middle cross-member, and three trapezoidal interface plates 112 wherein two are for the lower cross-member and one is for the upper cross-member.

The shapes of interface plates 108, 110, and 112 are primarily selected to optimize strength and stacking ability. The interface plates 108 and 112 of the upper and lower cross-members have an upper or lower edge, respectively, that is slightly offset from the upper or lower edge of the cross-member connected to them, respectively. That is, as demonstrated in FIGS. 2, 5 and 7, the interface plates 108 and 112 of the upper cross-member 104" have an upper edge 120 that is just slightly higher than the upper edge 124 of the upper cross member 104"; and the interface plates 112 of the lower cross-member 104 have a lower edge 122 that is just slightly lower than the lower edge 126 of the lower cross member 104, so as to account for the nominal height of the portion of the plate forming the notch 118.

Meanwhile, the shapes of the interface plates 110 for the middle cross-member are preferably triangular as shown. In these plates, the notch 118 is formed at the apex of the triangle and the angled sides 128 of the interface plate 110 extend away from the apex toward the outside post 102.

In another aspect, the shapes of some or all interface plates may be partially driven by other factors. It will be appreciated that the interface plates can be made of different shapes and that they may all match or not match at all. For example, the use of a rectangular interface plate 108 may be useful for placement of a branding label, even if the remaining interface plates are triangular or trapezoidal.

As mentioned, the interface plates provide a connection between the outside posts 102 and the cross-members. Additionally, the wire mesh 106 that is affixed to the cross-members and the outside posts 102 may also be welded to the interface plates 108, 110, 112 at their respective meeting points. The wire mesh 106 can either be overlaid upon the interface plates 108, 110, 112 or cut to meet the edges of the interface plates. The former option would generally provide a stronger weld bond than the latter.

Referring back to FIG. 5, the wire mesh 106 is placed inside frames formed by outside posts 102, cross members, and possibly interface plates 108, 110, and 112, approximately aligned with the common vertical center plane of these elements 102, 104, 108, 110 and 112 of the frame. The wire mesh is affixed to these elements 102, 104, 108, 110 and 112 preferably by welding at several points or continuously along the edges of the wire mesh. The approximate alignment along the common vertical center plane may actually be slightly offset to account for the overlaying of the wire mesh on the interface plates. However, the wire mesh should still be recessed away from the center posts and cross members to accommodate the stacking arrangement that will now be described.

Figure 10:
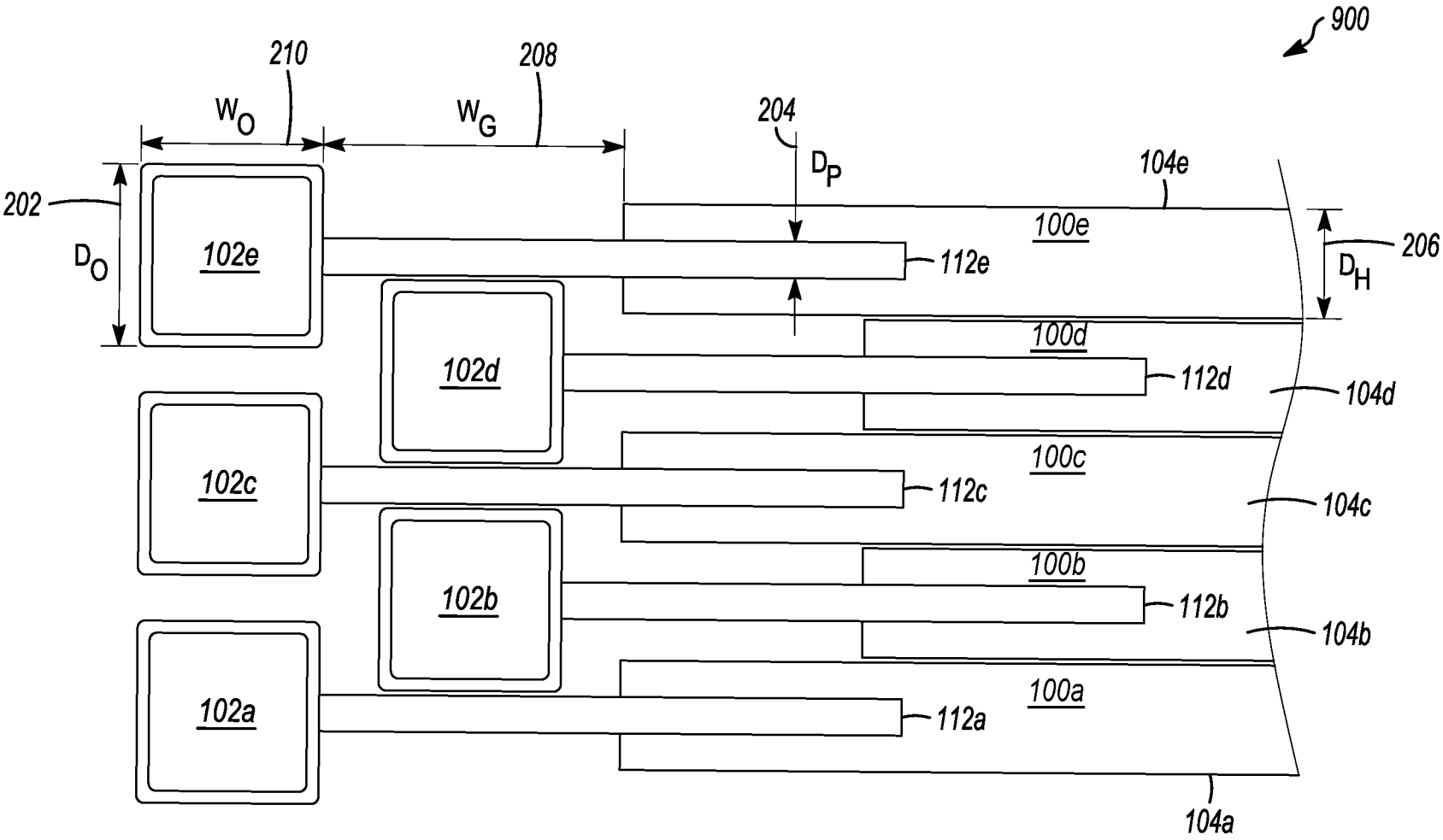
FIG. 10 illustrates a top view of the stacking arrangement of fencing panels as marked in FIG. 9.
Figure 11:
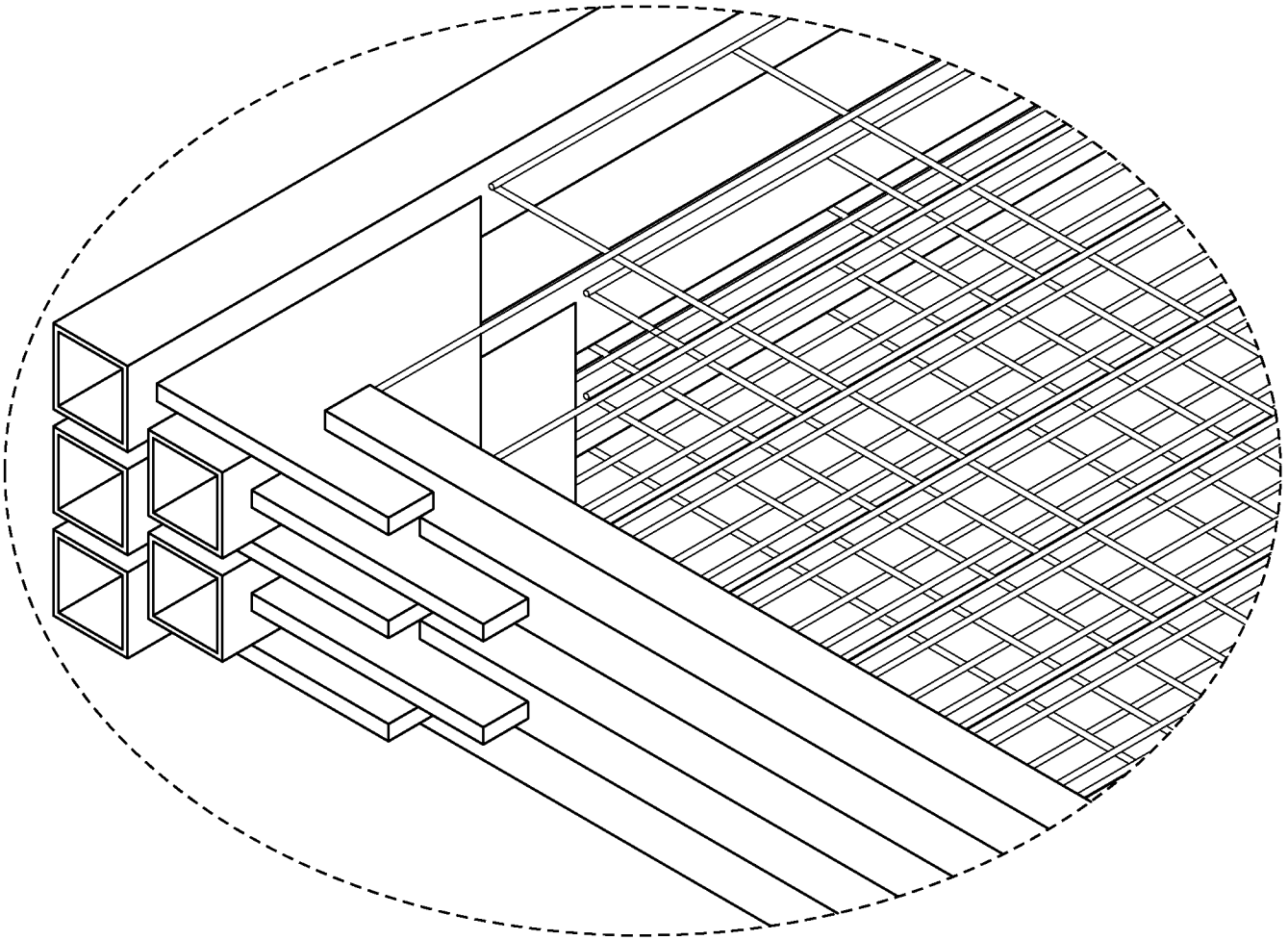
FIG. 11 illustrates an orthographic view of the stacking arrangement at an interface plate.
Figure 12:
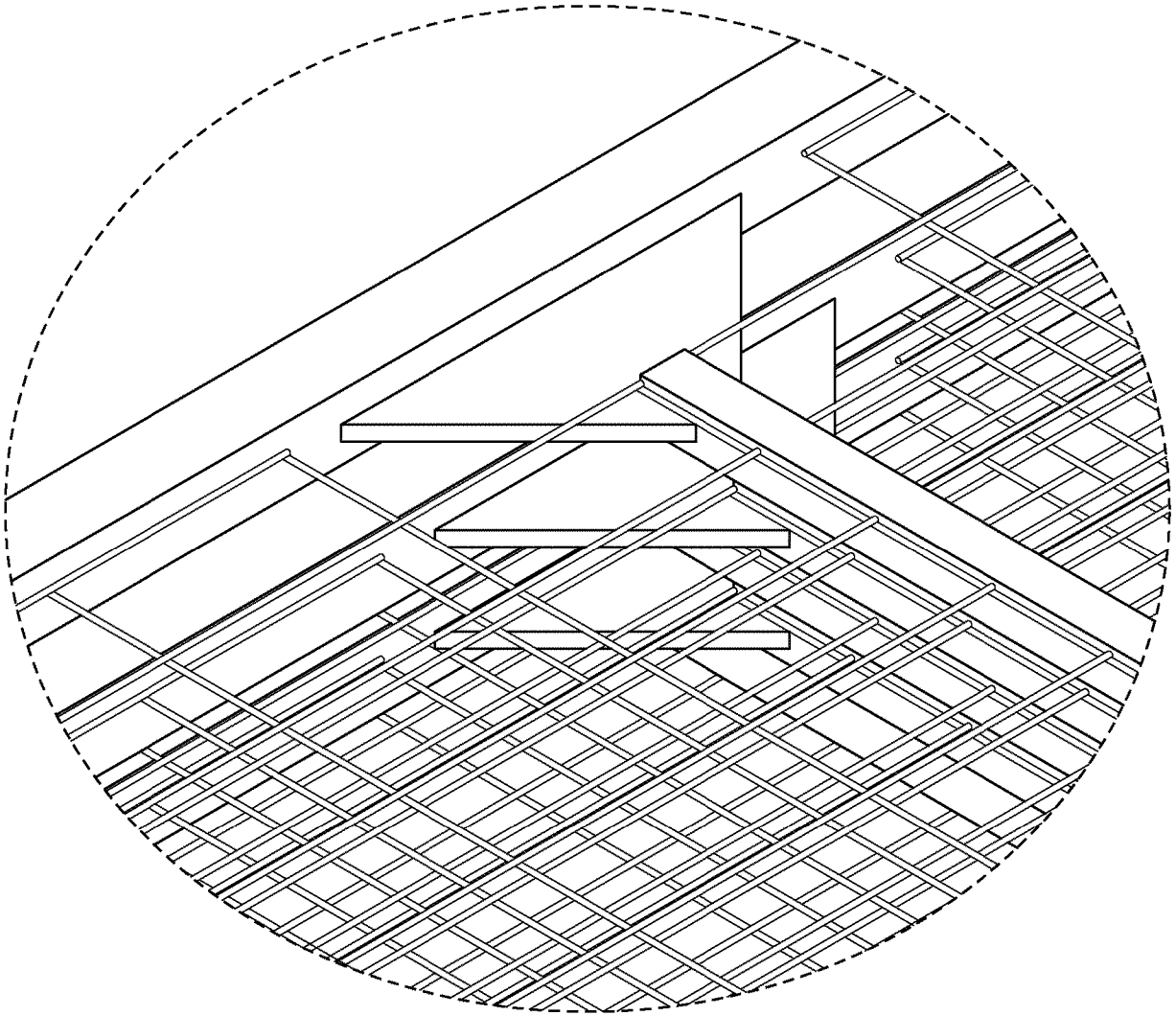
FIG. 12 illustrates an orthographic view of the stacking arrangement at another interface plate.
Figure 13:
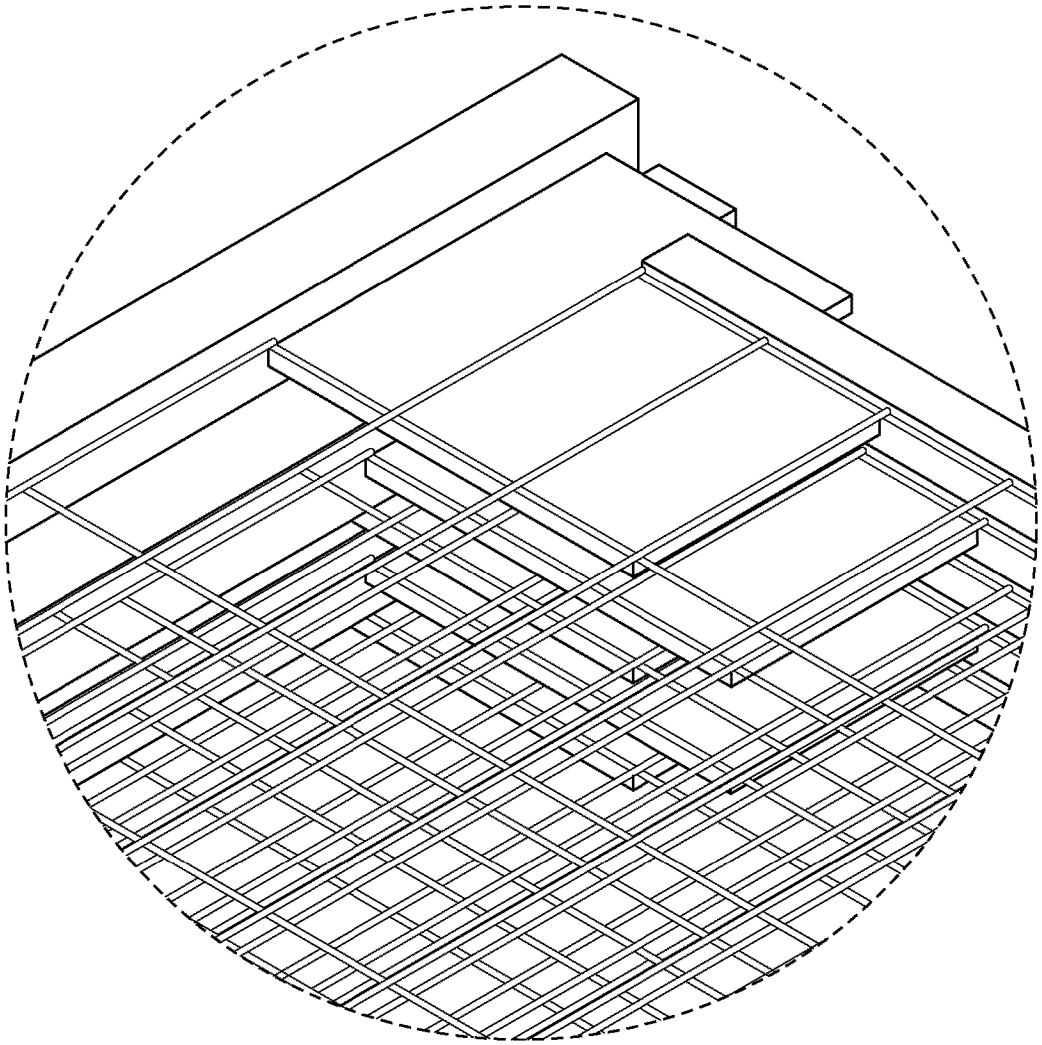
FIG. 13 illustrates an orthographic view of the stacking arrangement at yet another interface plate.

Turning now to FIGS. 9 to 13, several horizontally stacked units of fencing panels are shown, demonstrating the stacking benefits of the described fencing panel. FIG. 10 shows a closeup side view of the stacked fence panels.

The lowest unit of fencing panel 100*a* is placed flat on the ground, floor, a palette, floor of a truck, or the like. A subsequent unit of fencing panel 100*b* is placed above and horizontally offset from the lowest unit of fencing panel 100*a*. Thus, the outside posts 102*b* of the subsequent panel 100*b* are placed upon the interface plates 112*a* of the lowest unit of fencing panel 100*a* on one side, and on the other side, interface plates 112*b* are placed on the outside post 102*a* of the lower unit of fencing panel 100*a*. When the next fencing panel 100*c* is to be added to the stack, it can be placed in line with the first panel 100*a* which will be horizontally offset from the second panel 100*c* to permit a similar stacking benefit. Thus, the placement of posts and interface panels in a stacking of fence panels alternate in each layer. The horizontal cross-members on each stacked fencing panel are vertically aligned along their length with the corresponding horizontal cross-members of the fencing panel underneath it.

The gap between the cross-members and the outside posts 102 can be referred to as an interface gap $W_G$ 208. This interface gap must be at least as wide as the width $W_O$ of the outside posts 102 in order to accommodate the outside post 102 of an adjacent panel. Preferably, $W_G$ is slightly larger than $W_O$ so that absolute precision is not needed in the act of stacking the panels. This slightly larger approach also permits stacking even if the wire mesh weld points occupy some portion of the interface gap $W_G$.

In cases where the wire mesh overlays the interface plates, it may be that outside posts of one fence panel sit upon the wire mesh of the adjacent panel to some degree. This arrangement still permits suitable stacking as the wire mesh will firstly be deformable (flexible) so that the post, with enough mass placed on it, will sit near or on the interface plate and in any event the outside post is still nested into the gap $W_G$.

However, certain other dimensions of the fencing panel 100 will determine the efficiency of the stacking. For example, thickness '$D_P$' 204 of interface plates 110 should be less depth $D_O$ of the outside post 202 and also less than depth $D_H$ of cross-members to create a recess for accommodating the outside post of the adjacent panel.

Most optimally, as shown in FIG. 10, the relative depths (thicknesses) of the interface plates, outside posts and cross-members permits the cross-members (104*a*, 104*b*, 104*c*, 104*d*, 104*e*) to stack one upon another to increase the total points of contact among the stacked fencing panels. This would provide an optimally stable stack for storage and transport.

In one specific example, depth $D_H$ 206 of cross members is equal to half of the total sum of two elements comprising the depth $D_O$ 202 of the outside post 102 and the thickness $D_P$ 204 of interface plates 110. The interface gap $W_G$ 208 between the cross-members and the outside posts 102 is greater than the width $W_O$ 210 of the outside post 102.

In the current example, the width $W_O$ 210 and depth $D_O$ 202 of the outside post 102 are equal, however this is not required.

Some approaches to compacting of the stacking arrangement include using thinner tubes comprising the outside posts 102 and/or the horizontal cross-members and/or thinner interface plates. However, while these approaches may result in a more compact stacking arrangement, the panels themselves may become significantly less durable and not suitable for certain uses.

Embodiments of the present disclosure advantageously provide fencing panels having outside posts with, for example, a square tube design, and which has a compact horizontal stacking configuration. In this way, the many fencing companies that have invested considerable investments on, and built large inventories of, bases and caps can still use such bases and caps with the outside posts of the present embodiments. In some cases, roughly 30% of the cost of a panel set consists of the costs for such bases and caps.

Exemplary dimensions follow but are not intended to limit the claims in any way. In the illustrated example, the depth $D_O$ the outside posts can be 1.25 inches or 31.75 mm, the depth $D_H$ of cross-members can be 0.75 inches or 19.05 mm, the depth $D_P$ of the interface plates can be 0.25 inches or 6.35 mm, and the width of the interface gap $W_G$ between the tip of the cross-members and the side of the outside posts 102 is 1.9 inches or 48.26 mm. This means that each fencing panel would nest approximately 0.75 inches above the fencing panel under it; which is half of the total sum of $D_O$ and $D_P$ and also equal to the depth of cross-members $D_H$. This combination optimizes the compactness and provides a stable positioning of panels in a horizontal stack of fencing panels placed on top of each other.

Advantageously, this increased compactness allows for increased capacity on a truck or other transportation, dramatic reductions in labour and manpower required, reduced storage and warehouse spaces required. In addition, the interface plates result in better joints between components of panels, and the lighter cross-members result in lighter panels; which would increase health and safety of workers handling the panels and reduce transportation costs, and the cost of inspection and replacement, maintenance, and recycling of damaged panels. Also advantageously, the present embodiments can be safer because when the fencing panels are stacked and interlocked, they are less prone to spillage.

Figure 14:
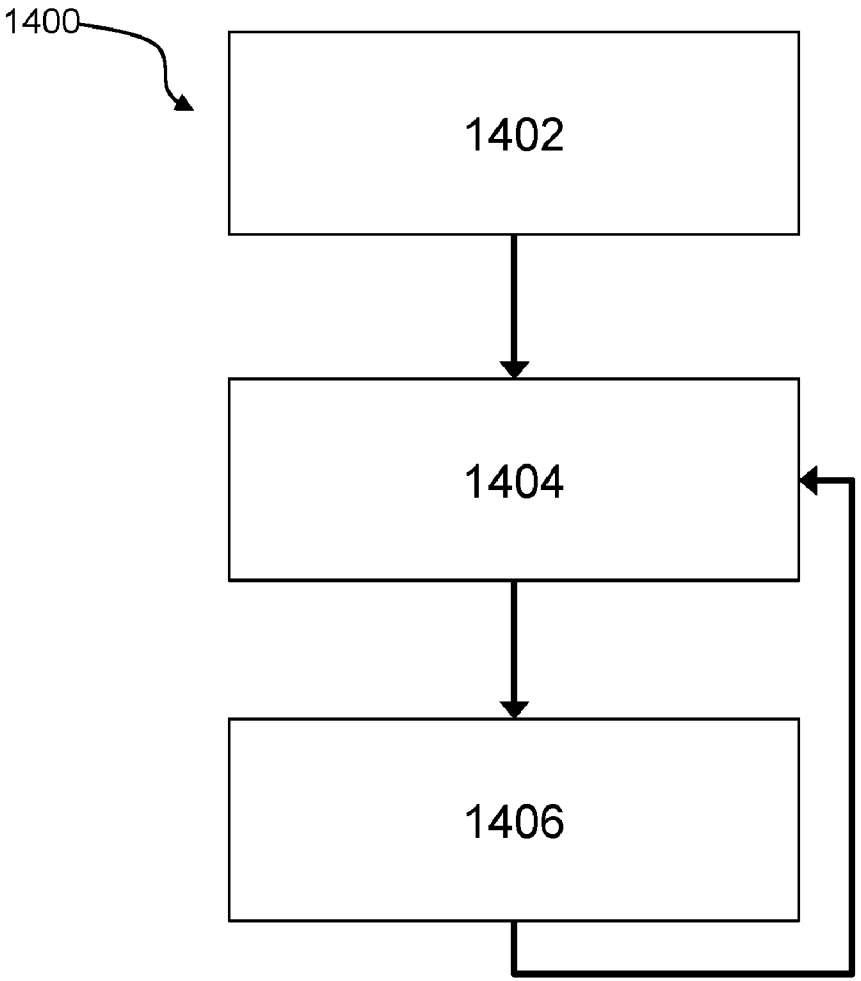
FIG. 14 is a flowchart of a method for horizontal stacking of fencing panels, according to an embodiment.

In overview, as shown in FIG. 14, there is provided a method for horizontal stacking of fencing panels 1400. The fencing panels having opposing outside posts and two or more horizontal cross-members positioned intermediate the opposing posts, and connected to the opposing posts using intermediate plates. At block 1402, a first fencing panel is positioned horizontally; for example, with its largest face on or parallel to the floor. At block 1404, a second fencing panel is positioned horizontally on the first fencing panel with one of the outside posts of the second fencing panel resting on the interface gaps on the interface plates on the same side of the first fencing panel and the interface gaps on the interface plates on the opposite side of the second fencing panel resting on the outside posts of the respective side of the first fencing panel. At block 1406, a third fencing panel is positioned horizontally on the second fencing panel with one of the outside posts of the third fencing panel resting on the interface gaps on the interface plates on the same side of the second fencing panel, on the side opposite the outside posts of the second fencing panel resting on the interface plates of the first fencing panel. The third fencing panel also having the interface gaps on the interface plates on the opposite side of the third fencing panel resting on the outside posts of the respective side of the second fencing panel. The alternating stacked configuration of blocks 1404 and 1406 can be repeated for further fencing panels in the stack.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

The invention claimed is:

1. A stackable fencing panel, the fencing panel comprising:

a first and a second outside post each comprising a post depth;

an upper and a lower cross-member each disposed between the first and second outside post and each comprising a cross-member depth;

a plurality of interface plates, each interface plate connecting each of the outside posts to each of the cross-members to form a frame, the interface plate having a thickness less than the post depth and less than the cross-member depth; and a wire mesh affixed within the frame; and the interface plate having a notch formed therein for retaining the respective cross-member spaced apart from the outside post by at least the post depth.

2. The stackable fencing panel of claim 1, wherein the first outside post and the second outside post comprise a square tube.

3. The stackable fencing panel of claim 1, wherein the cross-members comprise a square tube.

4. The stackable fencing panel of claim 1, further comprising a middle cross-member disposed in parallel midway between the upper and lower cross members defining two rectangular openings, the wire mesh affixed within one of the two rectangular openings and a further wire mesh affixed with the other of the two rectangular openings.

5. The stackable fencing panel of claim 1, wherein the wire mesh is a grid of rectangles formed of intersecting horizontal and vertical wire.

6. The stackable fencing panel of claim 1, wherein the notch of each interface plate comprises a horizontal notch to accommodate the corresponding cross-member.

7. The stackable fencing panel of claim 6, wherein during assembly, the cross-member is inserted into the notch and welded therein.

8. The stackable fencing panel of claim 6, wherein the notch is spaced apart from a side edge of the interface plate by an interface gap, the interface gap being at least a width of the outside post.

9. The stackable fencing panel of claim 8, wherein the interface gap is 1.9 inches.

10. The stackable fencing panel of claim 1, wherein each interface plate has a depth narrower than the cross-member depth.

11. The stackable fencing panel of claim 10, wherein the interface plate and cross-member are centrally aligned along their respective depths.

12. The stackable fencing panel of claim 1, wherein the wire mesh that is affixed to the frame is also welded to each interface plate at meeting points.

13. The stackable fencing panel of claim 12, wherein the wire mesh is aligned along a common vertical center plane of the outside posts, cross-members and interface plates.

14. The stackable fencing panel of claim 1, wherein the wire mesh is overlaid upon the interface plates.

15. The stackable fencing panel of claim 14, wherein the wire mesh is offset from a common vertical center plane of the outside posts, cross-members and interface plates.

16. The stackable fencing panel of claim 1, wherein the cross-member depth is equal to half of the total sum of the depth of the outside posts and the thickness of the interface plates.

17. The stackable fencing panel of claim 1, wherein the post depth is 1.25 inches.

18. The stackable fencing panel of claim 17, wherein the cross-member depth is 0.75 inches.

19. The stackable fencing panel of claim 18, wherein the thickness of the interface plates is 0.25 inches.

* * * * *